US006796227B1

(12) United States Patent
Miller

(10) Patent No.: US 6,796,227 B1
(45) Date of Patent: Sep. 28, 2004

(54) LITHOGRAPHIC PRESS DAMPENING CONTROL SYSTEM

(75) Inventor: Kurt R. Miller, Genesee Depot, WI (US)

(73) Assignee: Quad Tech, Sussex, WI (US)

( * ) Notice: Subject to any disclaimer, the term of this patent is extended or adjusted under 35 U.S.C. 154(b) by 0 days.

(21) Appl. No.: 10/643,095

(22) Filed: Aug. 18, 2003

(51) Int. Cl.[7] ..... B41F 7/30
(52) U.S. Cl. ..... 101/147
(58) Field of Search ..... 101/147, 148, 101/450.1, 451, 452

(56) References Cited

U.S. PATENT DOCUMENTS 4,881,182 A * 11/1989 Hank et al. ..... 101/365
5,050,994 A * 9/1991 Kipphan et al. ..... 356/445
5,090,316 A 2/1992 Rodi et al.
5,249,036 A 9/1993 Balducci
5,258,925 A * 11/1993 Maier et al. ..... 382/112
5,568,769 A * 10/1996 Leuerer ..... 101/450.1
5,713,286 A * 2/1998 Zorn ..... 101/450.1
5,791,249 A 8/1998 Quadracci
6,178,254 B1 * 1/2001 Rappette et al. ..... 382/112
6,601,512 B2 * 8/2003 Yamamoto et al. ..... 101/484
2003/0110963 A1 6/2003 Martin et al.

* cited by examiner

*Primary Examiner*—Stephen R. Funk
(74) *Attorney, Agent, or Firm*—Jeffrey W. Sainio

(57) ABSTRACT

A lithographic dampening control system measures the color strength of various tones of ink printed in multiple lateral locations across the width of a printing press to determine optimum dampening and controls multiple dampening control devices. By measuring and correcting for excess or inadequate dampening solution, proper dampening is maintained despite variations such as increased evaporation at machine edges due to heat from bearing friction.

18 Claims, 3 Drawing Sheets

LITHOGRAPHIC PRESS DAMPENING CONTROL SYSTEM

FIELD OF THE INVENTION

The invention is directed toward the field of lithographic printing press dampening control, more particularly to print-based automatic control of dampening across the width of the printing operation, such as the width of a printed web.

BACKGROUND OF THE INVENTION

Lithographic printing is based on the fact that oil and water don't mix. An image, typically on an aluminum printing plate, is created by a thin coating of oleophilic (oil-loving) material. Non-image areas are bare aluminum, which are entirely hydrophilic (water-loving). A printing plate rotates, first past some mechanism which applies a water solution called dampening solution to the hydrophilic areas, then to one or more rollers which apply oil-based ink to the remaining areas not repelling the ink by the water solution. Dampening solution, although loosely called water, also contains wetting agents, acids, fungicides and algicides, and often other compounds. The plate, with ink on the desired areas and water on the remainder, now prints ink onto a substrate, typically paper, either directly or more often via an intermediate 'blanket' roller. If several inks are to be applied, the paper may pass through several such 'print units,' applying, for instance, black, cyan, magenta, and yellow inks in sequence, and may apply the inks to both sides of the paper, thus forming printed images and text.

Water is applied to the plate in a variety of ways. A 'brush' system utilizes a rotary brush which is wetted against a roller which dips into a tray containing dampening solution. The brush bristles flick water onto intermediate rollers which wet the plate. A brush system is disclosed in U.S. Pat. No. 6,138,563 with attention to FIG. 6. This system guarantees one-way travel of the water, but is difficult to control and has largely been abandoned. A series of rubber dampening rollers may be used to transfer dampening solution to the plate. Any system which allows two-way water motion, backtracking from the plate back to the tray, risks ink rubbing off the plate and back through the roller train into the tray, contaminating the dampening solution with ink. Examples of such systems may be found in U.S. Pat. Nos. 5,249,036 and 5,957,054. Another method of water application is by a series of spray heads or nozzles across the width of the printing plate; being noncontact, no backtracking of ink is possible. Examples of spray dampeners are found in U.S. Pat. Nos. 4,198,907; 4,649,818; 4,815,375; 4,932,319; 5,025,722; and 5,595,116. A similar system with the advantage of not producing hard-to-control droplets is disclosed in U.S. Pat. No. 6,561,090; this system produces streaming rather than spraying of the dampener. For the purposes of this disclosure, "spray" shall be defined to encompass this streaming method or other squirting methods. A pulse-width-modulation system for controlling such spray nozzles is disclosed in U.S. Pat. No. 5,038,681.

Dampener consumption is not consistent across the plate. Consumption depends on ink coverage, ambient temperature which affects evaporation, and absorption rates of the paper being printed, which in turn, depends partially on the moisture content of the paper. The paper is often stored for extended periods prior to use, and the outer portions of the stored bulk paper are more prone to water evaporation or absorption, depending on ambient humidity. Therefore the dampening solution consumption may depend on whether it is near the edge of the paper as stored. On a high speed printing press, such variables may change quickly as a stack or roll of paper is consumed, leading to excess or inadequate dampening.

Excess dampening leads to 'emulsification' of water into the ink; tiny droplets of excess water mix into the ink on the various ink rollers. The ink is often applied to the substrate in the form of small halftone dots, which tend to be broken up and spread by the intruding water. Spreading of the halftone dots tends to give a darker or stronger color. Areas of solid ink are diluted by the intruding water, giving a weaker color. The resultant image therefore has undesired 'flat' color with poor contrast and a cartoonish look. Such color typically 'swims' (is inconsistent, with measurements varying with a standard deviation of about 0.1D or greater); 'swimming' is a convenient mnemonic for pressmen to remember that inconsistent color may be caused by excess water.

The best color, with sharp contrast and consistent dot structure, is provided with a minimum amount of water. However, inadequate dampening leads to a 'dryup;' without a protective water layer, ink will adhere to the plate in undesired locations where no ink belongs. The affected paper is 'tinted' with undesired color where white is desired. Note that both excess water and inadequate water will increase the density of halftone areas; excess water due to the dots being broken up by entrained water, inadequate water due to tinting of the white portion of the halftone. The tint is actually an apparently-random fine pattern, whose pattern is that of the aluminum crystal grain of the plate. If an optical system has adequate resolution to resolve the pattern, desired-white areas will show this grain pattern, which resembles optical noise and will be recognized by a high standard-deviation of brightness levels within the desired-white area. If the dryup is severe, it causes a significant consumption of ink, 'robbing' ink which would otherwise be in the proper printed image. The result is that solid tones of the expected ink are weakened by the loss of ink to the dryup.

The best-known example of inconsistent dampening is dryups at the paper edges of high-speed web presses; heat from the bearings of the various rollers, conducts to the edges of the various rollers, increasing evaporation. Dryups at the edges of the web are a common pressman's irritation, and control of color at the edge few inches of paper is notoriously unreliable.

To combat edge dryups, dampening rollers may be deliberately misaligned, with the left side canted slightly too high and the right side too low. This provides more 'squeeze' of the roller against the center of the next roller in the roller train, and more water removal at the center, with more water at the edges, preventing dryups. Similarly, a roller may be pressed tighter on one side than the other, to give more dampening on the needed side. Such mechanical adjustment is slow, manpower-intensive, and error-prone guesswork. Spray dampeners often have individual control of each spray head, a more convenient adjustment.

A limitation of these systems is that they lack feedback to control dampening according to the actual resultant printing, and do not recognize that needed dampening varies across the width of the paper. Feedback according to speed is disclosed in U.S. Pat. No. 6,138,563, and feedback according to water on the plate is disclosed in U.S. Pat. Nos. 5,520,113 and 6,138,563, but these are merely secondary indicators of the actual print quality. Online measurement of the actual resultant printing is disclosed in U.S. Pat. Nos. 5,791,249 and 6,058,201.

There exists a need for a control system which additionally controls dampening in a variable manner across the width of the paper, controlled by the actual resultant print.

SUMMARY OF THE INVENTION

The preferred form of the instant invention measures the printed ink in unprinted, partial-tone (meaning halftone dots partially covering the paper, not necessarily 50%), and full-tone areas in a multiplicity of zones (often called 'alleys' or 'key areas') across the width of the substrate to determine optimum dampening, and controls a corresponding multiplicity of dampening flow controls to provide an optimum quantity of dampener for each zone.

DETAILED DESCRIPTION OF THE PREFERRED EMBODIMENT

Figure 1:
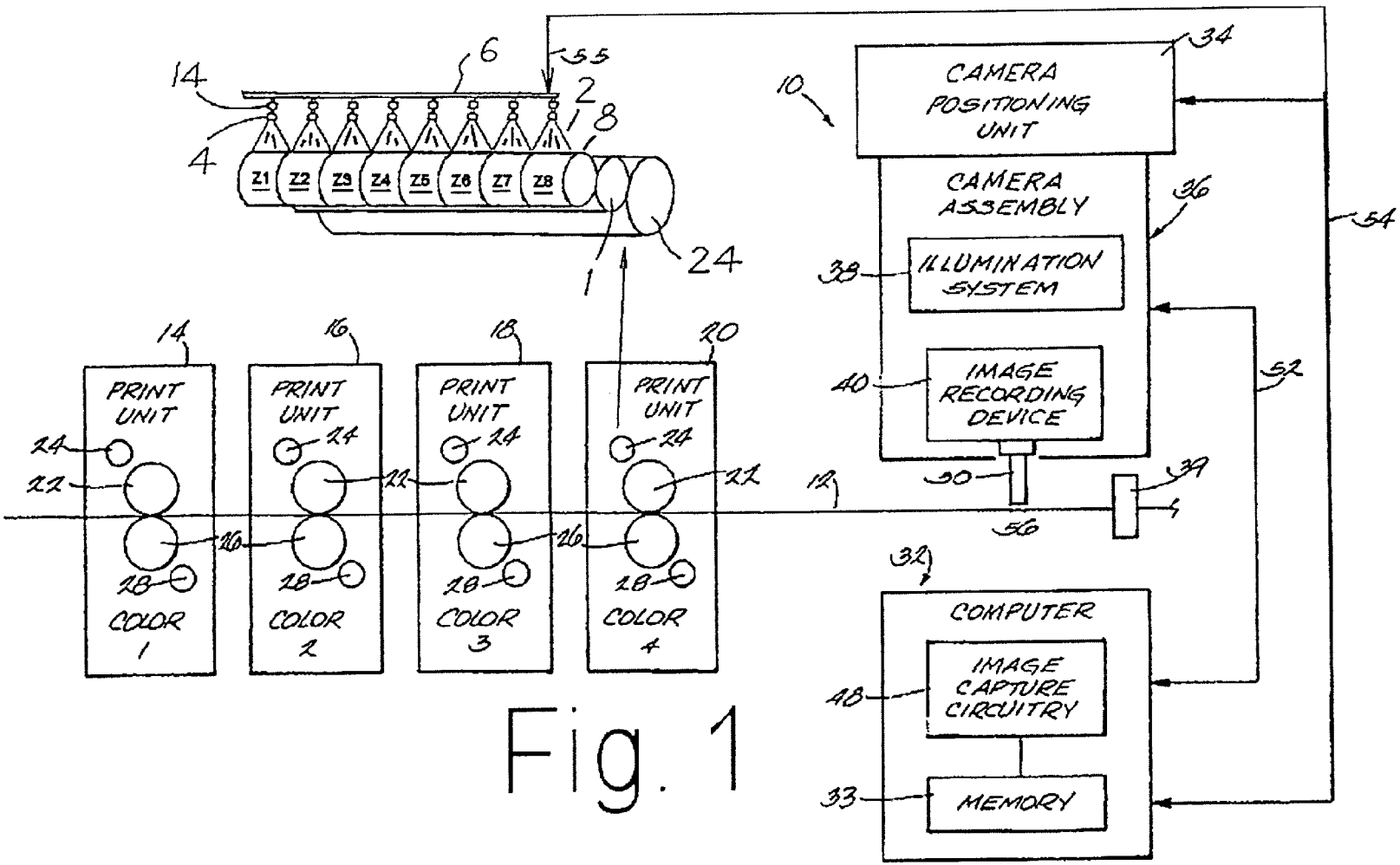
FIG. 1 shows a block layout of a web printing press with a color-measurement and control system (CCS) which measures the resultant print, and controls the spray heads of dampening system (only one of 8 such systems shown, one each for the upper and lower plates of 4 print units).

Referring to FIG. 1, a printing system 10 for printing a multi-color image upon a substrate or web 12 is illustrated. In the preferred embodiment, four printing units 14, 16, 18, and 20 each print one color of the image upon the web 12. This type of printing is commonly referred to as web offset printing. Each print unit 14, 16, 18 and 20 includes an upper blanket on cylinder 22, an upper printing plate on cylinder 24, a lower blanket on cylinder 26, and a lower printing plate on cylinder 28. In printing system 10, colors 1, 2, 3, and 4 on units 14, 16, 18, and 20 respectively, are typically black (K), cyan (C), magenta (M), and yellow (Y). The location of printing units 14, 16, 18, and 20 relative to each other is determined by the printer, and may vary.

The system 10 also includes a series of 24 to 36 keys (not shown) that control the application of ink to the plate cylinders 24 and 28. Each key controls the application of ink across an approximately 1.5 inch wide section of the plate cylinders 24 and 28. A change of key position will result in a change in the amount of ink applied to the corresponding area of the plate cylinders 24 and 28, and therefore a change in the ink density exhibited in this area. System 10 also includes a camera assembly 36 in optical communication with the web 12.

The calculation of the optical density of the printed image is performed as follows. The camera assembly 36 includes an illumination system 38 and an image recording device 40. Additionally, printing system 10 includes a camera positioning unit 34, a control system computer 32, and a web stabilizer 39.

In general operation, the camera positioning unit 34 moves the camera assembly 36 to a first position on the web 12. A printed image is illuminated by the illumination system 38 and the image recording device 40 records an image signal through lens 50 which is representative of the printed image within the field of view 56.

The illumination system 38 is synchronized with the movement of the web 12 such that the recorded image signal includes a portion of the color bars. The computer 32 may be of the conventional type including a Pentium microprocessor and PC architecture. Computer 32 includes random access memory 33 (semiconductor memory and/or disk drive storage) and image capture circuitry 48 which interface with the camera assembly 36.

Computer 32 is connected to camera positioning unit 34 by serial communication 54, and computer 32 sends control signals to the camera positioning unit 34. The camera positioning unit 34 is mechanically coupled to camera assembly 36 and moves the camera assembly 36 in a direction perpendicular to the web motion, termed the lateral direction (X-axis). The purpose of moving the camera assembly 36 across the web 12 is to allow selective image recording of lateral portions of the printed image on web 12. The camera assembly 36 records the printed image within the field of view 56 for various positions of the camera assembly 36 across the web 12. Web 12 is moving in the Y direction so that circumferential or Y-axis positioning by unit 34 is not necessary because the timing of the strobe light in the illumination system 38 effectively provides circumferential positioning relative to moving web 12.

Image capture circuitry 48 includes image capture boards which are connected to the expansion bus of computer 32. By way of example, the image capture circuitry may be of the bus board type manufactured by Synoptics of England SPR4000SCIB with 32 MB RAM which includes an A/D converter, and "Shademaster" diagnostic display driver.

Signal bus 52 transmits recorded image signals from camera assembly 36 to the computer 32, and camera control instructions from computer 32 to camera assembly 36. Image capture circuitry 48 is configured to produce a captured image signal array by converting the recorded image signals into an array of digital signals, of size 640 by 480 elements. The captured image signal arrays are stored in memory 33 of computer 32.

Computer 32 operates as a processing circuit to manipulate the captured image signal array for each color channel to correct for photometric zero, system nonlinearities, scattered light, and uneven white response. Also, computer 32 operates as an optical density conversion circuit by locating color patch boundaries within the captured image signal array and calculating the optical density of each individual color patch within the field of view, as described in U.S. Pat. No. 5,791,249.

A spray head mechanism 6 controlled by computer 32 via communication line 55, utilizes multiple spray heads 4 controlled by multiple individually-controlled valves 14 to form a spray 2 which is deposited on "pan roller" 8 (whose traditional name is obsolete with the elimination of the water pan below it) in zones Z1–Z8 which in turn wets oscillator roller 1 which spreads and evens out the dampener laterally and applies it to plate cylinder 24. Valves 14 may be analog (with variable spray volume) or preferably are pulse-width-modulated such as described in U.S. Pat. No. 5,038,681. Pulse-width modulation of the valves 14 provides more accurate control and higher resistance to clogging by small contaminants in the dampening solution. Only one such spray head mechanism is shown; actually, each of the printing plates 24 and 28 would also have such controlled spray heads.

Figure 2:
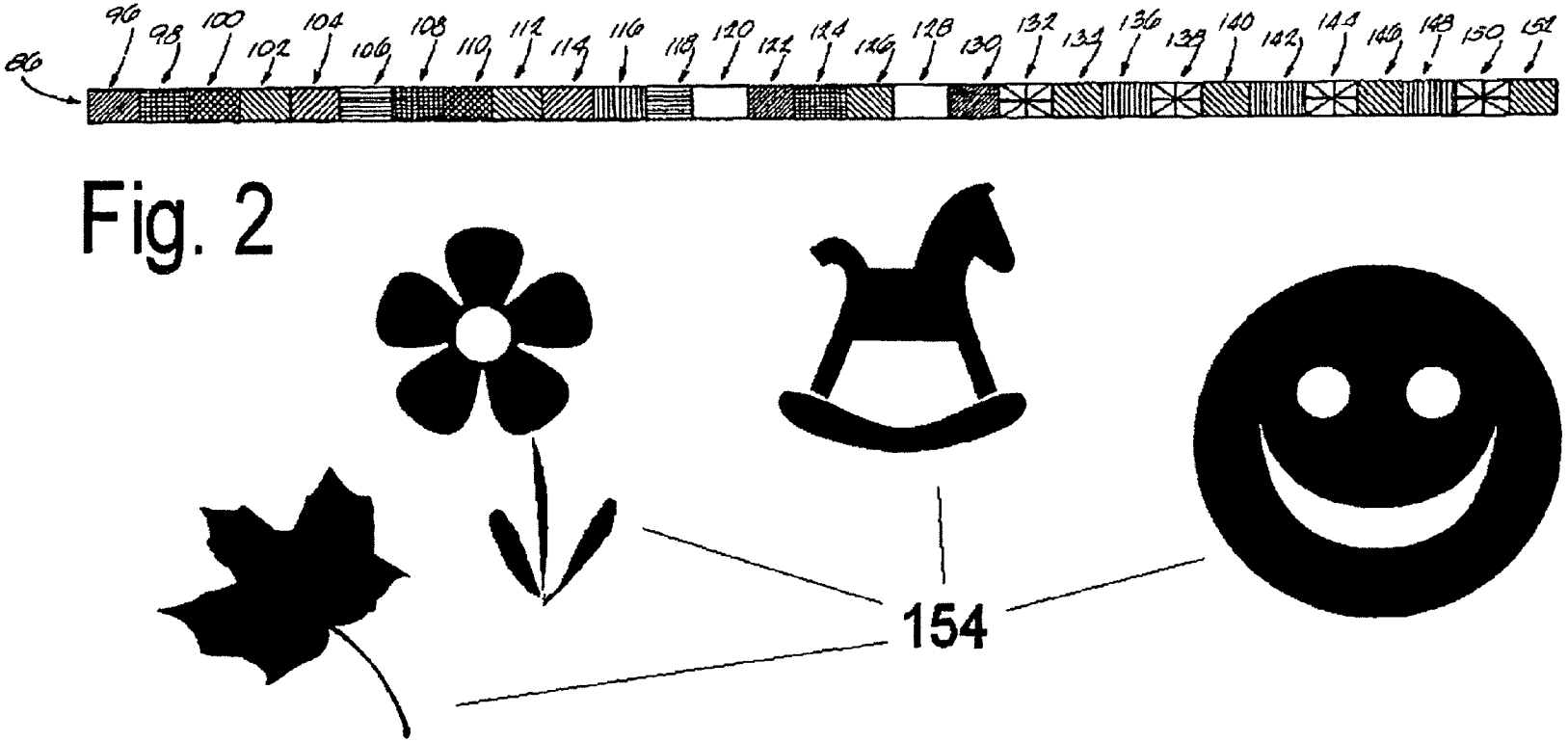
FIG. 2 shows a colorbar printed on the web which is read by the CCS.

Referring to FIG. 2, a colorbar is printed across the width of the paper, which contains partial-tone patches of 25%, 50%, 75%, and 100% (solid) ink printed by the various print units 14, 16, 18 and 20, as well as blank (unprinted) patches 120 and 128. The color patches are arranged side by side in a color bar across the web 12. Typically, this series of color patches is repeated across the web 12. The color bar is comprised of cyan, magenta, yellow, and black components. By way of illustration, color bar 86 may include the following color patches and their respective tones: black 100% 96, black 75% 98, black 50% 100, cyan 100% 102, cyan 75% 104, cyan 50% 106, magenta 100% 108, magenta 75% 110, magenta 50% 112, yellow 100% 114, yellow 75% 116, yellow 50% 118, white 120, blue 122, red 124, green 126, white 128, black 100% 130, black slur 132, black 25% 134, cyan 100% 136, cyan slur 138, cyan 25% 140, magenta 100% 142, magenta slur 144, magenta 25% 146, yellow 100% 148, yellow slur 150, yellow 25% 152; where 100% represents full tone of the ink, 50% represents half tone, and so forth. The web 12 also is printed with image material 154 or text.

Figure 3:
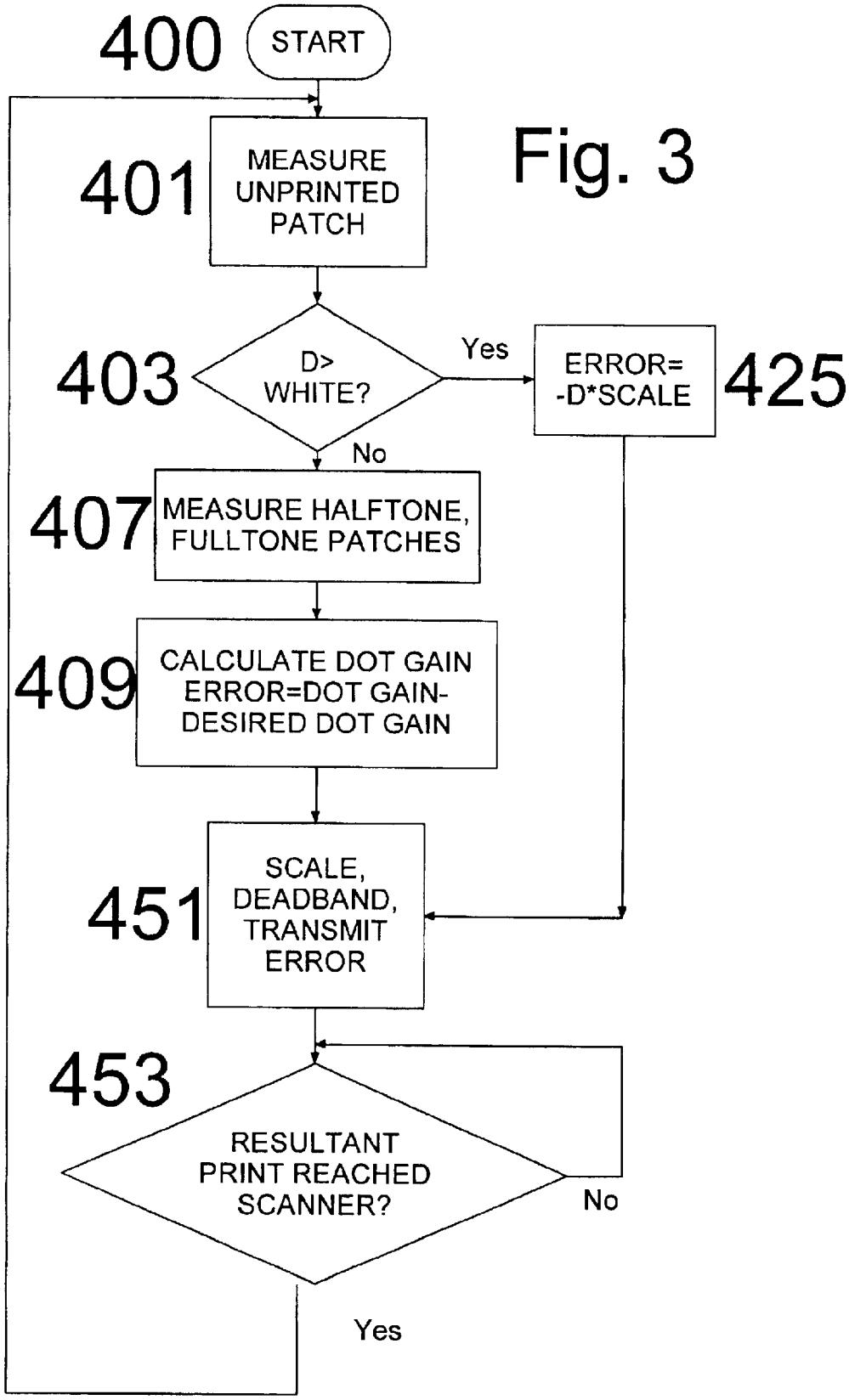
FIG. 3 is a flowchart of a control algorithm which regulates water flow in the respective zones.

Referring to FIG. 3, control of a print zone dampening is accomplished by computer 32 performing the flowcharted algorithm. Starting at 400, an unprinted white patch is measured at step 401. Paper brightness variations will provide a difference of about 0.03 to 0.1 D, typically about equally in the red, green, and blue channels of the camera; larger drops in brightness than this indicate extraneous ink on the substrate, typically caused by a dryup. (D is optical density, which is defined as the negative log of the ratio of the reflectance of printed versus unprinted substrate.) Alternatively, the random pattern of the dryup is detected by the resultant high standard-deviation (high noise or large variation) of the brightnesses of the pixels within the unprinted patch. As defined in this disclosure 'tone' refers to the percentage of oleophilic coating placed on a portion of the plate prior to printing, while 'density' relates to the resultant ink application to the substrate, which may vary due to ink and water supply variations.

If the appropriate color channel (a loss of blue channel brightness in the case of yellow ink, green channel brightness for magenta ink, red channel brightness for cyan ink, or all three about equally for black ink) provides an optical density D indicating the occurrence of 'tinting' due to a dryup (step 403), control jumps to step 425 where a correction is calculated and then 451 where the flow to the associated dampener spray head is increased, a delay at step 453 is performed to allow the resultant print to reach the camera assembly 36, and the print rechecked. (In reality, during the delay at step 453, the computer 32 would be testing other zones, communicating with peripherals or the operator, or various other tasks) Otherwise the solid patch (such as 96) density is compared at step 407 to a partial-tone patch (such as 98 or 100). As an example, the 50% magenta patch 112 density is compared to the solid magenta patch density 108 to derive a ratio corresponding to 'dot-gain.' Properly, 'dot-gain' is the increase in size of a 50% halftone dot; a 50% dot screen on a plate will occupy, for instance, 65% of the area on the paper, since the pressure of the plate or blanket on the paper will squish the ink into a larger area on the paper than the original dot size. In this example, a dot-gain of 65%–50% or 15% dot-gain results. Note that tinting, if present, will appear everywhere, including the desired-white areas in a halftone. Tinting may thus be confused with dot-gain if only partial-tone areas are examined. Tinting (inadequate water) can be distinguished from excess dot-gain (excess water) in that tinting will appear everywhere, including areas which are intended to remain white, while dot-gain will not affect white areas. Also note that in the rare case of all of the three process inks (cyan, magenta, and yellow) experiencing a dryup, the resultant tint will resemble a black dryup, since all three color channels will appear darker. The three-color dryup can be distinguished from the black dryup in that the high noise of the brightnesses of the pixels within the unprinted patch will appear identical in the three color channels of the camera 36, while in the case of a three-color dryup, the three colors will look unrelated; i.e. the random grain pattern in the red channel will look different than in the green or blue channel. Note also that under proper control of dampener by measurement of the various tones, the extreme condition of a dryup should be corrected before dryup actually occurs, so that on a press which is properly controlled and not subject to extreme upsets, dryup detection may not be needed.

Most measurement systems measuring dot-gain actually measure the ratio of the reflected light of the 50% and solid inked areas, simulating a measurement of the true dot-gain. Excess water appears twice in this measurement; the solid density decreases while the partial-tone density increases. The resultant ratio is therefore a differential signal with higher reliability. At step 409, the ratio representing dot-gain is compared to a desired dot-gain, which may be entered by the press operator and will vary dependent on several variables, such as paper quality. For instance, lower-grade paper will typically exhibit higher dot-gain. Also, the printing method known as stochastic printing is susceptible to a degradation known as piling, which may be alleviated by running a slight excess of water, with the side effect of higher dot-gain. A variable target dot-gain may be human-entered to compensate for such situations.

At step 451, the error from step 409 is conditioned such as by scaling or passing through a deadband operation, and the result is transmitted to increase or decrease the dampening flow to the associated spray head as needed. The transmitted scaling may also be according to a preferred factor from the press operator, and according to press speed, as is well known in the art. Steps 401–453 are repeated for each zone across the width of the paper. Generally, there are more than one partial-tone and solid patches of each ink in a zone; often there are dozens of such patches in each zone. Measurements from these patches may be averaged to provide an overall measurement for the zone, or alternatively, patches in-line with a critical-color area may provide the measurement for the entire zone.

The 'swimming' nature of the color may be used as a diagnostic of excess dampener. If the previous number of measurements, for example the trend over 10 measurements, of either a full-tone or halftone area, shows 'noisy' readings (a large standard deviation of the readings) with no other cause, such as ink-key positional changes, typically larger than about 0.1D standard deviation, excess dampening may be diagnosed. In this situation, the algorithm of FIG. 4 step 409 would calculate $$\text{ERROR}=(\text{DOT-GAIN}-\text{DESIRED DOT-GAIN})+\text{SWIM}$$

where 'swim' represents the measurement noise, such as the standard deviation of the previous 10 measurements, appearing over the previous number of measurements, and scaled, offset, or deadbanded as appropriate. Such a diagnosis may be used in conjunction with the measurement of dot-gain, for instance if a pressman hand-enters an unrealistic target dot-gain, as could happen when a pressman mistakenly enters a target dot-gain for uncoated paper (which is characterized by high dot gain), when the job being run is utilizing coated paper (characterized by low dot gain). In this example, the system could diagnose excess 'swim' and provide a warning to the pressman.

The invention is not limited to the preferred mode illustrated. For instance, the invention is disclosed for simplicity as operating on a single fountain, but generally would act on all colors printed on a web. Disclosure is of a single surface of a single web, but operation would be equally applicable on both surfaces of the paper, and of multiple webs of paper in a multi-web press. The disclosed invention is shown on a web press, but would be operative on a sheetfed press. Paper is disclosed as the printed substrate, but other materials such as cardboard are applicable. The patch measurement system is disclosed as online, but could be done offline. The preferable measurement is of a partial-tone patch compared to a solid patch, but other measurements, such as a 50% patch compared to a 75% patch, could be operative. Measurement of inks are disclosed in a colorbar, but the printed image 154 itself could be used, as disclosed in U.S. Pat. No. 5,967,050, using white substrate, halftone areas, and fulltone areas found in the printed image itself. A single computer is disclosed as performing the computing and control functions, but these tasks could be spread over several computers. The controlled dampening devices are disclosed as spray heads, but any system of dampening which provides a multiplicity of controlled zones across the width of the paper (such as the apparatus of U.S. Pat. No. 4,811,661, modified to be constructed of multiple modular sections across the paper) would suffice. For instance, a multiplicity of controlled squeegees, placed across the width of a traditional pan roller to remove a controlled amount of water, would also suffice. These and other variants are within the spirit and scope of the claims below.

What is claimed is:

1. A method of controlling the dampening of a printing plate of a lithographic printing press, comprising:

A. Adjustably dampening (6) a printing plate (24) at a multiplicity of zones (Z1–Z8) across the width of said plate;

B. Printing an ink (100) on a substrate (12) with said plate;

C. Measuring (407), at a multiplicity of measurement locations (56), densities of a partial-tone area (100) and a full-tone area (96) of the ink printed on the substrate at each of the multiplicity of zones;

D. Calculating (409), from a comparison of the partial-tone and full-tone densities, a dampener feed error at each of the multiplicity of zones;

E. Based on the dampener feed error, adjusting a dampener feed rate (451) at each of the multiplicity of zones.

2. The method of claim 1, where the densities are measured within a colorbar (86) printed on paper.

3. The method of claim 1, where the densities are measured within a printed image (154).

4. The method of claim 1, where dampening is by a noncontact system (6).

5. The method of claim 4, where the adjustment of dampener feed is by pulse-width modulation of a valve (14) controlling the spray (2) of a spray head (4).

6. The method of claim 1, where calculation of the dampener feed error, comprises comparing each zone's solid ink density to the zone's halftone density to derive the dot-gain (409) of the ink.

7. The method of claim 6, where calculation of the dampener feed error, additionally comprises measurement of the density of an area of the substrate whose corresponding plate area (120, 128) is entirely hydrophilic (401).

8. The method of claim 6, where calculation of the dampener feed error, additionally comprises calculation of the swim of the measurements.

9. The method of claim 1, additionally comprising the step of:

F. Delaying until the print resulting from step E has reached the measurement location (453), then repeating step A.

10. The method of claim 9, where steps A–F are performed for a plurality of colors of ink.

11. An apparatus for controlling the dampening of a printing plate of a lithographic printing press, comprising:

A. A printing plate (24) which prints an ink (100) on a substrate (12);

B. A plate dampener (6) which adjustably dampens the printing plate at a multiplicity of zones (Z1–Z8) across the width of said plate;

C1. A control system (32) which measures (407) densities of a partial-tone area (100) and a full-tone area (96) of the ink printed on the substrate at each of the multiplicity of zones; and C2. calculates, from a comparison of the partial-tone and full-tone densities, a dampener feed error (409) at each of the multiplicity of zones; and C3. adjusts, based on the dampener feed error, a dampener feed rate (451) at each of the multiplicity of zones.

12. The apparatus of claim 11, where the densities are measured within a colorbar (86) on paper.

13. The apparatus of claim 11, where the densities are measured within a printed image (154).

14. The apparatus of claim 11, additionally comprising a spray head (4) fed by a valve (14) controlling the dampener feed rate by pulse-width modulation.

15. The apparatus of claim 11, where calculation of the dampener feed error, comprises comparing each zone's solid ink density to the zone's halftone density to derive the dot-gain (409) of the ink.

16. The apparatus of claim 15, where calculation of the dampener feed error, additionally comprises measurement of the density of an area of the substrate whose corresponding plate area (120) is entirely hydrophilic (401).

17. The apparatus of claim 11, where calculation of the dampener feed error is performed for each of the ink colors black, cyan, magenta, and yellow.

18. An apparatus for controlling the dampening of a printing plate of a lithographic printing press, comprising:

A. Printing means (24) which prints an ink (100) on a substrate (12);

B. Plate dampener means (6) which adjustably dampens the printing plate at a multiplicity of zones (Z1–Z8) across the width of said plate;

C. Measurement means (36) which measures (407) the densities of a partial-tone area (100) and a full-tone area (96) of the ink printed on the substrate at each of the multiplicity of zones;

D. Computing means (32) which calculates, from a comparison of the partial-tone and full-tone densities, a dampener feed error (409) at each of the multiplicity of zones, and E. adjusts, based on each dampener feed error, a dampener feed rate (451) at each of the multiplicity of zones.

* * * * *